US010249398B2

(12) United States Patent
Eriksson et al.

(10) Patent No.: US 10,249,398 B2
(45) Date of Patent: Apr. 2, 2019

(54) TARGET ASSEMBLY AND ISOTOPE PRODUCTION SYSTEM HAVING A VIBRATING DEVICE

(71) Applicant: General Electric Company, Schenectady, NY (US)

(72) Inventors: Tomas Eriksson, Uppsala (SE); Bert Holmgren, Uppsala (SE)

(73) Assignee: General Electric Company, Schenectady, NY (US)

( * ) Notice: Subject to any disclaimer, the term of this patent is extended or adjusted under 35 U.S.C. 154(b) by 905 days.

(21) Appl. No.: 14/755,007

(22) Filed: Jun. 30, 2015

(65) Prior Publication Data

US 2017/0004897 A1 Jan. 5, 2017

(51) Int. Cl.

| | |
|---|---|
| ***G21C 1/10*** | (2006.01) |
| ***G21G 1/00*** | (2006.01) |
| ***G21G 1/10*** | (2006.01) |
| ***H05H 6/00*** | (2006.01) |

(52) U.S. Cl.
CPC ..... *G21G 1/0005* (2013.01); *G21G 1/10* (2013.01); *H05H 6/00* (2013.01)

(58) Field of Classification Search
CPC .. G21G 1/00; G21G 1/10; G21K 5/00; G21K 5/02; G21K 5/04; G21K 5/08; G21K 5/10
See application file for complete search history.

(56) References Cited

U.S. PATENT DOCUMENTS

| | | | | |
|---|---|---|---|---|
| 3,525,228 | A | 8/1970 | Anderson | |
| 5,280,505 | A | 1/1994 | Hughey et al. | |
| 6,584,747 | B2 | 7/2003 | Erdman | |
| 6,917,044 | B2 | 7/2005 | Amini | |
| 8,249,211 | B2 | 8/2012 | Buckley | |
| 2011/0255646 | A1 | 10/2011 | Eriksson et al. | |
| 2012/0321026 | A1* | 12/2012 | Norling | G21G 1/10 376/190 |
| 2016/0023182 | A1* | 1/2016 | Tadokoro | G21G 1/10 204/157.44 |

FOREIGN PATENT DOCUMENTS

| | | | |
|---|---|---|---|
| WO | 2003099208 | A2 | 12/2003 |
| WO | 2011133281 | A1 | 10/2011 |
| WO | 2013003039 | A1 | 1/2013 |

OTHER PUBLICATIONS

Alba-Baena et al.; "Kinetics of Ultrasonic Degassing of Aluminium Alloys", Light Metals, 2013, pp. 957-962.

(Continued)

*Primary Examiner* — Marshall P O'Connor
(74) *Attorney, Agent, or Firm* — Dean D. Small; The Small Patent Law Group, LLC

(57) ABSTRACT

Target assembly for an isotope production system. The target assembly includes a target body having a production chamber and a beam cavity that is adjacent to the production chamber. The production chamber is configured to hold a target liquid. The beam cavity opens to an exterior of the target body and is configured to receive a particle beam that is incident on the production chamber. The target assembly also includes a vibrating device that is secured to the target body. The vibrating device is configured to cause vibrations that are experienced within the production chamber.

13 Claims, 9 Drawing Sheets

(56) References Cited

OTHER PUBLICATIONS

Doster J M; "New Cyclotron Targetry to Enhance F-18 Clinical Position Emission Tomography", Dec. 18, 2008, pp. 1-52.
International Search Report and Written Opinion for corresponding PCT application No. PCT/US2016/031610 dated Aug. 1, 2016; 14 pages.
Cyclotron Produced Radionuclides: Operation and Maintenance of Gas and Liquid Targets, IAEA Radioisotopes and Radiopharmaceuticals Series No. 4., International Atomic Energy Agency Vienna, 2012; pp. 24-61.

* cited by examiner

TARGET ASSEMBLY AND ISOTOPE PRODUCTION SYSTEM HAVING A VIBRATING DEVICE

BACKGROUND

The subject matter disclosed herein relates generally to isotope production systems, and more particularly to isotope production systems having liquid targets that are irradiated with a particle beam.

Radioisotopes (also called radionuclides) have several applications in medical therapy, imaging, and research, as well as other applications that are not medically related. Systems that produce radioisotopes typically include a particle accelerator, such as a cyclotron, that accelerates a beam of charged particles (e.g., H– ions) and directs the beam into a target material to generate the isotopes. The cyclotron includes a particle source that provides the particles to a central region of an acceleration chamber. The cyclotron uses electrical and magnetic fields to accelerate and guide the particles along a predetermined orbit within the acceleration chamber. The magnetic fields are provided by electromagnets and a magnet yoke that surrounds the acceleration chamber. The electrical fields are generated by a pair of radio frequency (RF) electrodes (or lees) that are located within the acceleration chamber. The RF electrodes are electrically coupled to an RF power generator that energizes the RF electrodes to provide the electrical field. The electrical and magnetic fields cause the particles to take a spiral-like orbit that has an increasing radius. When the particles reach an outer portion of the orbit, the particles may form a particle beam that is directed toward the target material for isotope production.

Target material (also referred to as starting material) is typically housed within a chamber of a target assembly that is positioned within the path of the particle beam. In some systems, the target material is a liquid (hereinafter referred to as a target liquid). The chamber may be defined by a recess within a target body and a foil that covers the recess. The particle beam is incident on the foil and the target liquid within the chamber. The particle beam deposits a relatively large amount of power (e.g., 1-2 kW) within a relatively small volume of the target liquid (e.g., 1-3 ml). The thermal energy generated within the chamber drives the target liquid to a boiling state. Consequently, bubbles are generated within the target liquid along a surface of the foil or from within the volume of the target liquid.

The bubbles may cause some unwanted effects. For example, the production chamber is typically divided into a liquid region and a gas or vapor region, which is positioned above the liquid region. The bubbles generated within the liquid region eventually rise to the gas region. When a greater proportion of bubbles exists within the liquid region, the bubbles may permit the particle beam to travel completely through the liquid region without causing the desired changes to the isotopes of the target liquid. As such, the bubbles may reduce the efficiency of radioisotope production. Furthermore, a greater proportion of bubbles within the liquid region may reduce the target liquid's ability to absorb thermal energy from the foil. It may be necessary to more frequently replace or refurbish the target assembly.

Conventional methods of reducing bubble formation include cooling the production chamber by flowing liquid or gas through channels that are proximate to the production chamber. Bubble formation may also be reduced by pressurizing the production chamber with an inert gas, such as helium or argon. Such methods, however, may have only a limited effectiveness.

BRIEF DESCRIPTION

In an embodiment, a target assembly for an isotope production system is provided. The target assembly includes a target body having a production chamber and a beam cavity that is adjacent to the production chamber. The production chamber is configured to hold a target liquid. The beam cavity opens to an exterior of the target body and is configured to receive a particle beam that is incident on the production chamber. The target assembly also includes a vibrating device that is secured to the target body. The vibrating device is configured to cause vibrations that are experienced within the production chamber.

In some embodiments, the vibrating device may include, for example, at least one of (a) a piezoelectric actuator or (b) an electric motor. Optionally, the target body includes first and second body sections that are secured to one another in fixed positions with respect to one another. The production chamber is defined by at least one of the first body section or the second body section. The vibrating device is secured to at least one of the first body section or the second body section.

In an embodiment, an isotope production system is provided. The isotope production system includes a particle accelerator configured to generate a particle beam and a target assembly that includes a target body having a production chamber and a beam cavity that is adjacent to the production chamber. The production chamber is configured to hold a target liquid. The beam cavity is positioned to receive the particle beam from the particle accelerator such that the particle beam is incident on the production chamber. The target assembly includes a vibrating device that is secured to the target body. The isotope production system also includes a control system that is operatively coupled to the particle accelerator and the target assembly. The control system is configured to activate the vibrating device when the particle beam is activated. The vibrating device is configured to cause vibrations that are experienced within the production chamber.

Optionally, the control system is configured to activate the vibrating device in response to determining that the particle beam has obtained a threshold beam current. Optionally, the vibrating device is configured to operate within a range of operating frequencies. The control system may be configured to select an operating frequency of the vibrating device based on the beam current of the particle beam.

In an embodiment, a method of generating radioisotopes is provided. The method includes directing a particle beam to be incident on a target liquid within a production chamber of a target body. The production chamber includes a liquid region and a gas region. The particle beam causes bubbles to form within the liquid region of the production chamber. The method also includes vibrating the target body to cause the bubbles to move from the liquid region to the gas region.

Optionally, the method may include detecting a beam current of the particle beam, wherein vibrating the target body includes vibrating the target body in response to determining that the particle beam has obtained a threshold beam current.

DETAILED DESCRIPTION

Figure 1:
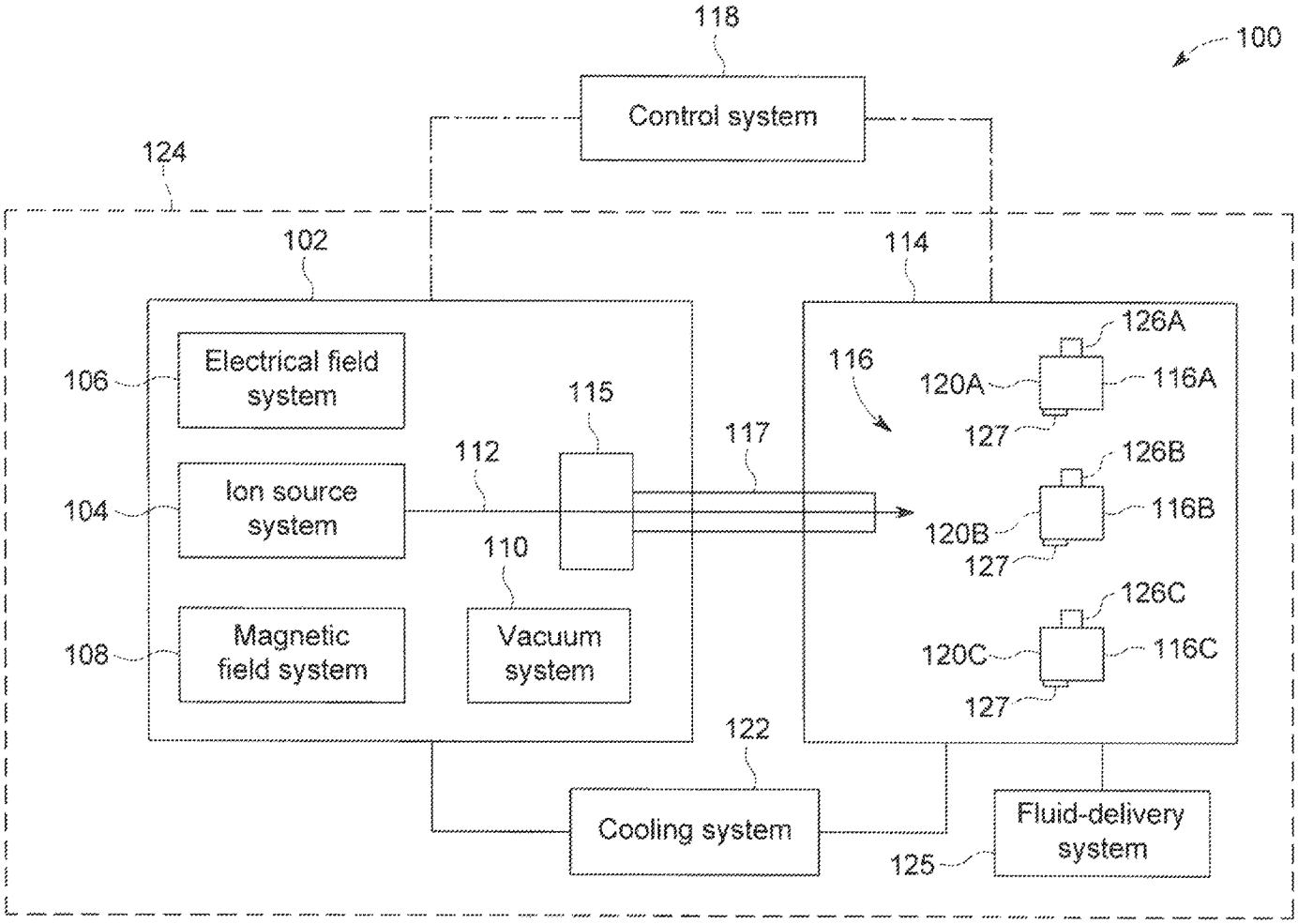
FIG. 1 is a block diagram of an isotope production system in accordance with an embodiment.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 is a block diagram of an isotope production system 100 formed in accordance with an embodiment. The isotope production system 100 includes a particle accelerator 102 (e.g., cyclotron) having several sub-systems including an ion source system 104, an electrical field system 106, a magnetic field system 108, a vacuum system 110, a cooling system 122, and a fluid-control system 125. During use of the isotope production system 100, a target material 116 (e.g., target liquid) is provided to a designated production chamber 120 of the target system 114. The target material 116 may be provided to the production chamber 120 through the fluid-control system 125. The fluid-control system 125 may control flow of the target material 116 through one or more pumps and valves (not shown) to the production chamber 120. The fluid-control system 125 may also control a pressure that is experienced within the production chamber 120 by providing an inert gas into the production chamber 120. During operation of the particle accelerator 102, charged particles are placed within or injected into the particle accelerator 102 through the ion source system 104. The magnetic field system 108 and electrical field system 106 generate respective fields that cooperate with one another in producing a particle beam 112 of the charged particles.

Also shown in FIG. 1, the isotope production system 100 has an extraction system 115. The target system 114 may be positioned adjacent to the particle accelerator 102. To generate isotopes, the particle beam 112 is directed by the particle accelerator 102 through the extraction system 115 along a beam transport path or beam passage 117 and into the target system 114 so that the particle beam 112 is incident upon the target material 116 located at the designated production chamber 120. It should be noted that in some embodiments the particle accelerator 102 and target system 114 are not separated by a space or gap (e.g., separated by a distance) and/or are not separate parts. Accordingly, in these embodiments, the particle accelerator 102 and target system 114 may form a single component or part such that the beam passage 117 between components or parts is not provided.

The isotope production system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. The isotope production system 100 may produce the isotopes in predetermined amounts or batches, such as individual doses for use in medical imaging or therapy. By way of example, the isotope production system. 100 may generate protons to make $^{18}F^{-}$ isotopes in liquid form. The target material used to make these isotopes may be enriched $^{18}O$ water or $^{16}O$-water. In some embodiments, the isotope production system 100 may also generate protons or deuterons in order to produce $^{15}O$ labeled water. Isotopes having different levels of activity may be provided.

In some embodiments, the isotope production system 100 uses $^{1}H^{-}$ technology and brings the charged particles to a low energy (e.g., about 8 MeV) with a beam current of approximately 10-30 μA. In such embodiments, the negative hydrogen ions are accelerated and guided through the particle accelerator 102 and into the extraction system 115. The negative hydrogen ions may then hit a stripping foil (not shown in FIG. 1) of the extraction system 115 thereby removing the pair of electrons and making the particle a positive ion, $^{1}H^{+}$. However, in alternative embodiments, the charged particles may be positive ions, such as $^{1}H^{+}$, $^{2}H^{+}$, and $^{3}He^{+}$In such alternative embodiments, the extraction system 115 may include an electrostatic deflector that creates an electric field that guides the particle beam toward the target material 116. It should be noted that the various embodiments are not limited to use in lower energy systems, but may be used in higher energy systems, for example, up to 25 MeV and higher beam currents.

The isotope production system 100 may include a cooling system 122 that transports a cooling fluid (e.g., water or gas, such as helium) to various components of the different systems in order to absorb heat generated by the respective components. For example, one or more cooling channels may extend proximate to the production chambers 120 and absorb thermal energy therefrom. The isotope production system 100 may also include a control system 118 that may be used to control the operation of the various systems and components. The control system 118 may include the necessary circuitry for automatically controlling the isotope production system 100 and/or allowing manual control of certain functions. For example, the control system 118 may include one or more processors or other logic-based circuitry. The control system 118 may include one or more user-interfaces that are located proximate to or remotely from the particle accelerator 102 and the target system 114. Although not shown in FIG. 1, the isotope production system 100 may also include one or more radiation and/or magnetic shields for the particle accelerator 102 and the target system 114.

The isotope production system 100 may be configured to accelerate the charged particles to a predetermined energy level. For example, some embodiments described herein accelerate the charged particles to an energy of approximately 18 MeV or loss. In other embodiments, the isotope production system 100 accelerates the charged particles to an energy of approximately 16.5 MeV or less. In particular embodiments, the isotope production system 100 accelerates the charged particles to an energy of approximately 9.6 MeV or less. In more particular embodiments, the isotope production system 100 accelerates the charged particles to an energy of approximately 7.8 MeV or less. However, embodiments describe herein may also have an energy above 18 MeV. For example, embodiments may have an energy above 100 MeV, 500 MeV or more. Likewise, embodiments may utilize various beam current values. By way of example, the beam current may be between about of approximately 10-30 μA. In other embodiments, the beam current may be above 30 μA, above 50 μA, or above 70 μA. Yet in other embodiments, the beam current may be above 100 μA, above 150 μA, or above 200 μA.

The isotope production system 100 may have multiple production chambers 120A-C where separate target materials 116A-C are located. A shifting device or system (not shown) may be used to shift the production chambers 120A-C with respect to the particle beam 112 so that the particle beam 112 is incident upon a different target material 116. A vacuum may be maintained during the shifting process as well. Alternatively, the particle accelerator 102 and the extraction system 115 may not direct the particle beam 112 along only one path, but may direct the particle beam 112 along a unique path for each different production chamber 120A-C. Furthermore, the beam passage 117 may be substantially linear from the particle accelerator 102 to the production chamber 120 or, alternatively, the beam passage 117 may curve or turn at one or more points therealong. For example, magnets positioned alongside the beam passage 117 may be configured to redirect the particle beam 112 along a different path.

As described herein, embodiments may include vibrating devices 126 (referenced as 126A, 126B, 126C) that are directly coupled to a body that defines the production chamber 120. The vibrating device 126 may also be referred to as a vibrator or shaker and is configured to generate mechanical movement (e.g., vibrations) of the body that are experienced within the production chamber. As described herein, bubbles may be generated within the production chamber along surfaces that define the production chamber or within the liquid region in the production chamber. The vibrations may facilitate or expedite the detachment of bubbles from the surfaces and the floating of bubbles to a vapor region formed above the liquid region. In such embodiments, the vibrations may reduce the amount of time that the bubbles are located within the liquid and, consequently, reduce the unwanted effects that the bubbles have on the density of the liquid region. In some embodiments, the vibrating devices 126 are controlled by the control system 118. For example, the control system 118 may activate the vibrating devices 126 alter one or more criteria have been detected. More specifically, the control system 118 may be communicatively coupled to one or more sensors 127 that detect a designated operating parameter, such as beam current, of the isotope production system 100. In other embodiments, the vibrating device 126 may be activated when the particle accelerator 102 is activated.

Examples of isotope production systems and/or cyclotrons having one or more of the stab-systems described herein may be found in U.S. Patent Application Publication No. 2011/0255646, which is incorporated herein by reference in its entirety. Furthermore, isotope production systems and/or cyclotrons that may be used with embodiments described herein are also described in U.S. patent application Ser. Nos. 12/492,200; 12/435,903; 12/435,949; 12/435,931 and 14/754,878 each of which is incorporated herein by reference in its entirety. The vibrating devices (or vibrators or shakers) described herein may be similar to the electromechanical motors described in U.S. Pat. No. 8,653,762, which is incorporated herein by reference in its entirety.

Figure 2:
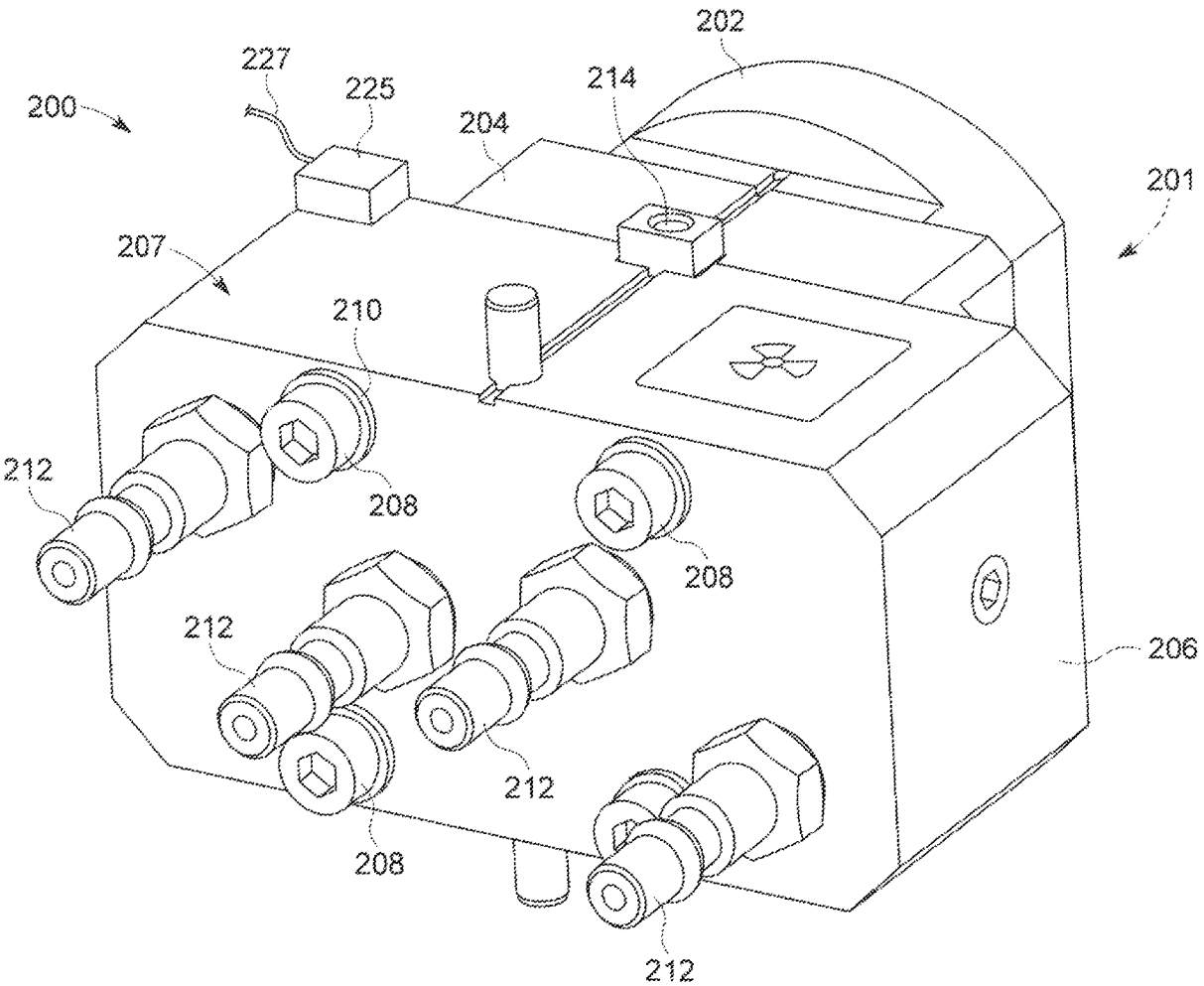
FIG. 2 is a perspective view of a target assembly in accordance with an embodiment.
Figure 3:
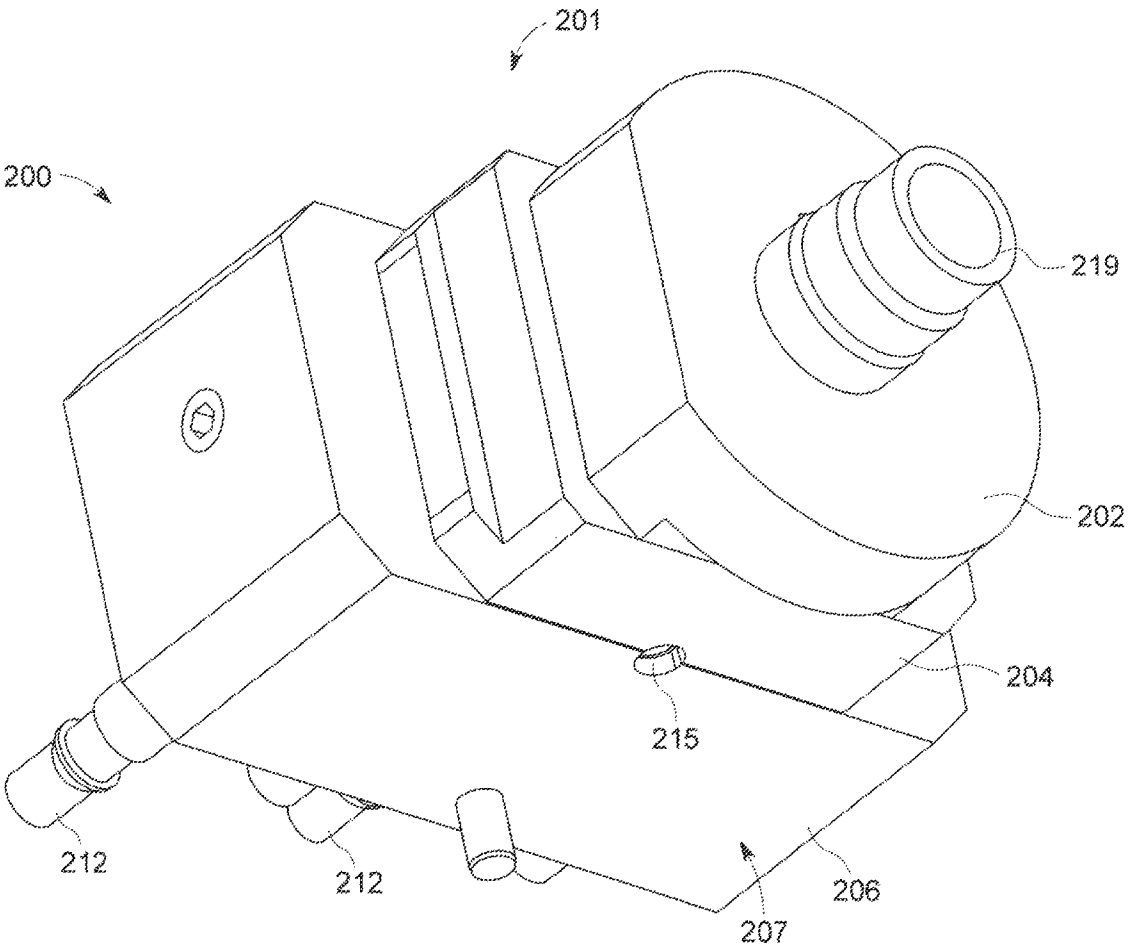
FIG. 3 is another perspective view of the target assembly of FIG. 2.
Figure 4:
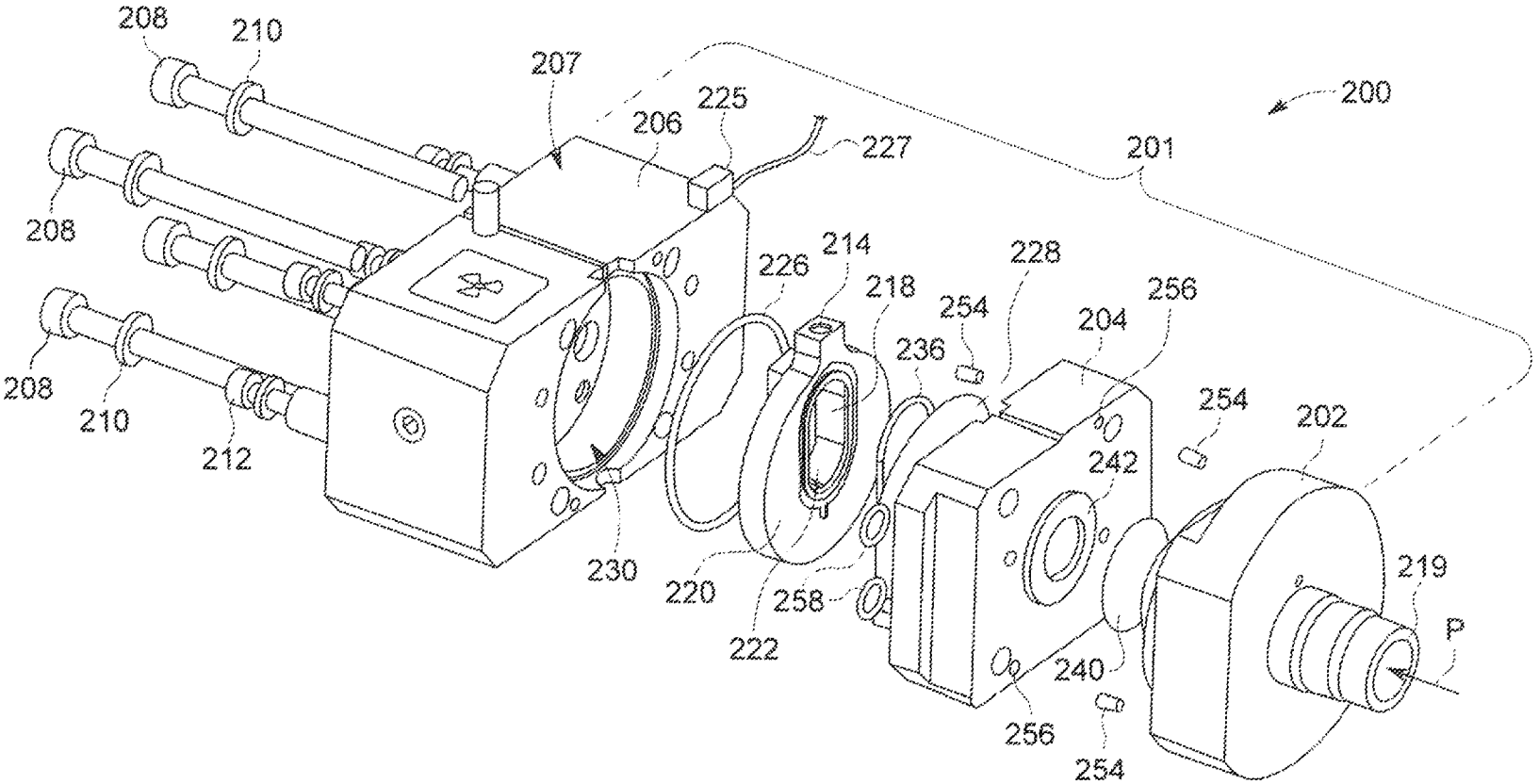
FIG. 4 is an exploded view of the target assembly of FIG. 2.
Figure 5:
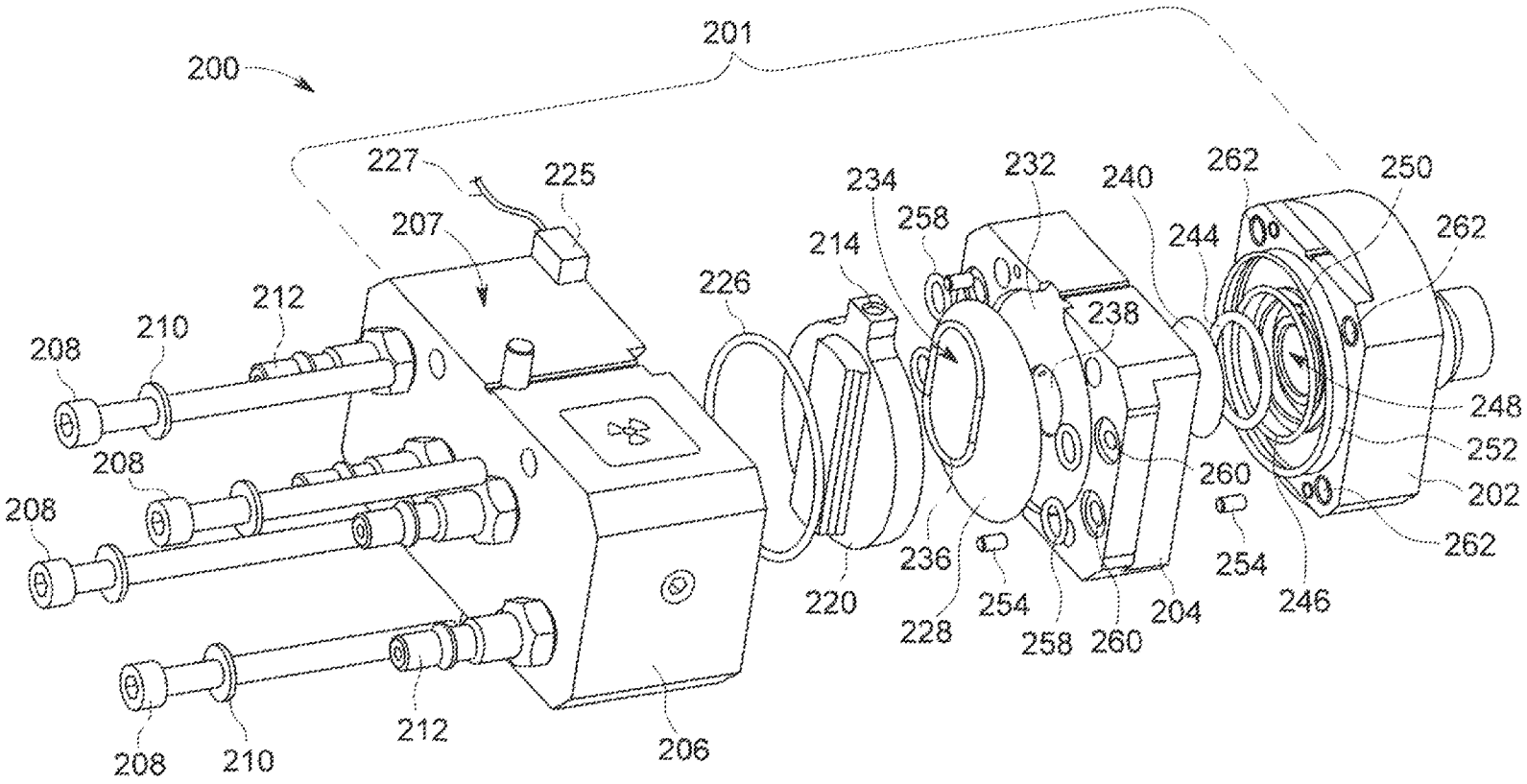
FIG. 5 is another exploded view of the target assembly of FIG. 2.

FIGS. 2 and 3 are rear and front perspective views, respectively, of a target assembly 200 formed in accordance with an embodiment. FIGS. 4 and 5 are exploded views of the target assembly 200. The target assembly 200 includes a target body 201 and a vibrating device 225 (shown in FIGS. 2, 4, and 5) that is configured to be attached to the target body 201. The target body 201 is fully assembled in FIGS. 2 and 3. The target body 201 is formed from three body sections 202, 204, 206 and a target insert 220 (FIGS. 4 and 5). The body sections 202, 204, 206 define an outer structure of the target body 201. In particular, the outer structure of the target body 201 is formed from a body section 202 (which may be referred to as a front body section or flange), a body section 204 (which may be referred to as an intermediate body section) and a body section 206 (which may be referred to as a rear body section). The body sections 202, 204 and 206 include blocks of rigid material having channels and recesses to form various features. The channels and recesses may hold one or more components of the target assembly 200. The body sections 202, 204, and 206 may be secured to one another by suitable fasteners, illustrated as a plurality of bolts 208 (FIGS. 2, 4, and 5) each having a corresponding washer 210. When secured to one another, the body sections 202, 204 and 206 form a sealed target body 201.

Also shown, the target assembly 200 includes a plurality of fittings 212 that are positioned along a rear surface 213. The fittings 212 may operate as ports that provide fluidic access into the target body 201. The fittings 212 are configured to be operatively coupled to a fluid-control system, such as the fluid-control system 125 (FIG. 1). The fittings 212 may provide fluidic access for helium and/or cooling water. In addition to the ports formed by the fittings 212, the target assembly 200 may include a first material port 214 and a second material port 215. The first and second material ports 214, 215 are in flow communication with a production chamber 218 (FIG. 4) of the target assembly 200. The first and second material ports 214, 215 are operatively coupled to the fluid-control system. In an exemplary embodiment, the second material port 215 may provide a target material to the production chamber 218, and the first material port 214 may provide a working gas (e.g., inert gas) for controlling the pressure experienced by the target liquid within the production chamber 218. In other embodiments, however, the first material port 214 may provide the target material and the second material port 215 may provide the working gas.

The target body 201 forms a beam passage or cavity 221 that permits a particle beam (e.g., proton beam) to be incident on the target material within the production chamber 218. The particle beam (indicated by arrow P in FIG. 4) may enter the target body 201 through a passage opening 219 (FIGS. 3 and 4). The particle beam travels through the target assembly 200 from the passage opening 219 to the production chamber 218 (FIG. 4). During operation, the production chamber 218 is filled with a target liquid, for example, with about 2.5 milliliters (ml) of water comprising designated isotopes (e.g., $H_2{}^{18}O$). The production chamber 218 is defined within the target insert 220 that may comprise, for example, a Niobium material having a cavity 222 (FIG. 4) that opens on one side of the target insert 220. The target insert 220 includes the first and second material ports 214, 215. The first and second material ports 214, 215 are configured to receive, for example, fittings or nozzles.

With respect to FIGS. 4 and 5, the target insert 220 is aligned between the body section 206 and the body section 204. The target assembly 200 may include a sealing ring 226 that is positioned between the body section 206 and the target insert 220. The target assembly 200 also includes a foil member 228 and a sealing border 236 (e.g., a Helicoflex® border). The foil member 228 may comprise a metal alloy disc comprising, for example, a heat-treatable cobalt base alloy, such as Havar®. The foil member 228 is positioned between the body section 204 and the target insert 220 and covers the cavity 222 thereby enclosing the production chamber 218. The body section 206 also includes a cavity 230 (FIG. 4) that is shaped and sized to receive therein the sealing ring 226 and a portion of the target insert 220. Additionally, the body section 206 includes a cavity 232 (FIG. 4) that is sized and shaped to receive therein a portion of the foil member 228. The foil member 228 is also aligned with an opening 238 (FIG. 5) to a passage through the body section 204.

Optionally, a foil member 240 may be provided between the body section 204 and the body section 202. The foil member 240 may be an alloy disc similar to the foil member 228. The foil member 240 aligns with the opening 238 of the body section 204 having an annular rim 242 (FIG. 4) therearound. As shown in FIG. 4, a seal 244, a sealing ring 246, and a sealing ring 250 are concentrically aligned with an opening 248 of the body section 202 and couple onto a rim 252 of the body section 202. The seal 244, the sealing ring 246, and the sealing ring 250 are provided between the foil member 240 and the body section 202. It should be noted more or fewer foil members may be provided. For example, in some embodiments only the foil member 228 is included. Accordingly, a single foil member or multi-foil member arrangements are contemplated by the various embodiments.

It should be noted that the foil members 228 and 240 are not limited to a disc or circular shape and may be provided in different shapes, configurations and arrangements. For example, the one or more the foil members 228 and 240, or additional foil members, may be square shaped, rectangular shaped, or oval shaped, among others. Also, it should be noted that the foil members 228 and 240 are not limited to being formed from a particular material, but in various embodiments are formed from a an activating material, such as a moderately or high activating material that can have radioactivity induced therein as described in more detail herein. In some embodiments, the foil members 228 and 240 are metallic and formed from one or more metals.

As shown in FIGS. 4 and 5, a plurality of pins 254 are received within openings 256 in each of the body sections 202, 204 and 206 to align these component When the target assembly 200 is assembled. Additionally, a plurality of sealing rings 258 align with openings 260 of the body section 204 for receiving therethrough the bolts 208 that secure within bores 262 (e.g., threaded bores) of the body section 202.

During operation, as the particle beam passes through the target assembly 200 from the body section 202 into the production chamber 218, the foil members 228 and 240 may be heavily activated (e.g., radioactivity induced therein). The foil members 228 and 240, which may be, for example, thin (e.g., 5-50 micrometer or micron (μm)) foil alloy discs, isolate the vacuum inside the accelerator, and in particular the accelerator chamber and from the target liquid in the cavity 222. The foil members 228 and 240 also allow cooling helium to pass therethrough and/or between the foil members 228 and 240. It should be noted that the foil members 228 and 240 are configured to have a thickness that allows a particle beam to pass therethrough. Consequently, the foil members 228 and 240 may become highly radiated and activated.

Some embodiments provide self-shielding of the target assembly 200 that actively shields the target assembly 200 to shield and/or prevent radiation from the activated foil members 228 and 240 from leaving the target assembly 200. Thus, the foil members 228 and 240 are encapsulated by an active radiation shield. Specifically, at least one of, and in some embodiments, all of the body sections 202, 204 and 206 are formed from a material that attenuates the radiation within the target assembly 200, and in particular, from the foil members 228 and 240. It should be noted that the body sections 202, 204 and 206 may be formed from the same materials, different materials or different quantities or combinations of the same or different materials. For example, body sections 202 and 204 may be formed from the same material, such as aluminum, and the body section 206 may be formed from a combination or aluminum and tungsten.

The body section 202, body section 204 and/or body section 206 are formed such that a thickness of each, particularly between the foil members 228 and 240 and the outside of the target assembly 200 provides shielding to reduce radiation emitted therefrom. It should be noted that the body section 202, body section 204 and/or body section 206 may be formed from any material having a density value greater than that of aluminum. Also, each of the body section 202, body section 204 and/or body section 206 may be formed from different materials or combinations or materials as described in more detail herein.

The vibrating device 225 is configured to be secured to at least one of the body sections. As used herein, when a vibrating device is "secured to" a component, the vibrating device is attached to the component in a manner that is sufficient for transferring vibrations into the component. The vibrating device may be secured by one or more elements. For example, the vibrating device may include a housing that is secured to the target body through hardware (e.g., screws or bolts). Alternatively or in addition to the hardware, the vibrating device may be secured to the target body through other types of fasteners (e.g., latches, clasps, belts, and the like) and/or an adhesive. By way of example, a target body, such as the target body 201, may include first and second body sections that are secured to each other and have fixed positions relative to each other. A production chamber may be defined by at least one of the first body section or the second body section. The vibrating device may be secured to at least one of the first body section or the second body section.

Compared to systems that do not utilize a vibrating device, the vibrating device may generate vibrations that cause bubbles formed within the production chamber 218 to more quickly detach from surfaces that define the production chamber. In some cases, compared to systems that do not utilize a vibrating device, the vibrating device 225 may increase the rate or speed at which the bubbles rise within the target liquid to a gap region within the production chamber.

As shown in FIGS. 2, 4, and 5, the vibrating device 225 is secured to the body section 206. In other embodiments, however, the vibrating device 225 may be secured to the body section 204, the body section 202, or the target insert 220. In other embodiments, the vibrating device 225 may be simultaneously secured to more than one body section. For example, if the exterior surfaces of two body sections are flush or even, the vibrating device 225 may extend across the interface between the two body sections.

In the illustrated embodiment, the vibrating device 225 is secured to an outer or exterior surface 207 of the body section 206. In other embodiments, the vibrating device 225 may be positioned within a recess, cavity, or chamber of the target assembly 200. In the illustrated embodiment, the vibrating device 225 is electrically connected to a control system (not shown), such as the control system 118 (FIG. 1), through one or more wires 227 so that the control system may control operation of and/or supply power to the vibrating device 225. It is contemplated, however, that the vibrating device 225 may be wirelessly controlled and/or receive power through wireless transfer power.

FIGS. 6-9 illustrate vibrating devices that may be similar or identical to the vibrating device 126 (FIG. 1) or the vibrating device 225 (FIG. 2). The vibrating devices may be driven at a designated frequency and amplitude that facilitates removing the bubbles or, more specifically, causing the bubbles to more quickly detach from surfaces that define the production chamber and/or causing the bubbles to move more quickly from a liquid region to a gas region within the production chamber.

Figure 6:
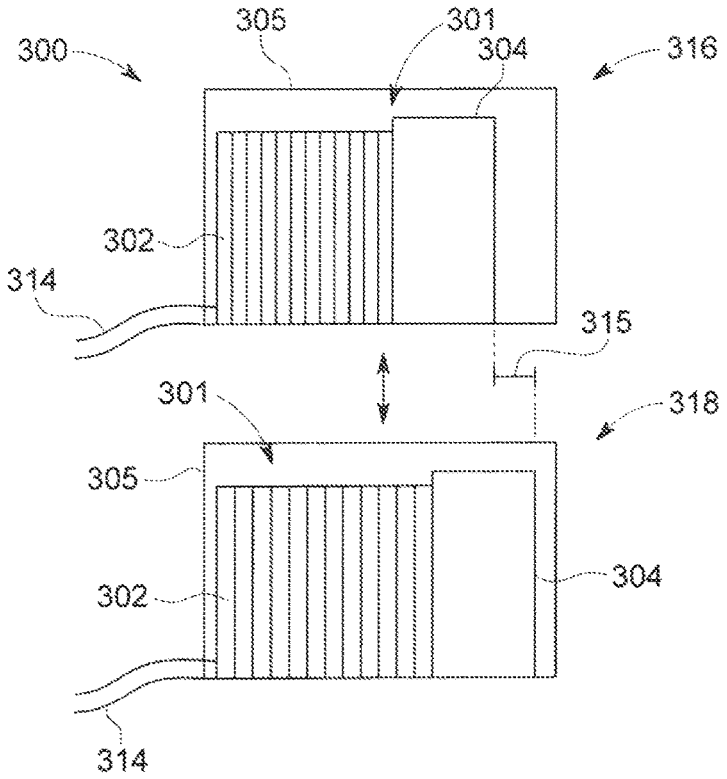
FIG. 6 is a side cross-section of a vibrating device in accordance with an embodiment illustrating the vibrating device in a first operating state and in a second operating state.

FIG. 6 shows side cross-section of a vibrating device 300 in first and second states 316, 318. The vibrating device 300 includes a piezoelectric actuator 301 having a series of piezoelectric elements 302 that are operatively coupled to a mass or weight 304. The piezoelectric elements 302 of the vibrating device 300 may be relatively insensitive to ionizing radiation. In the illustrated embodiment, the piezoelectric elements 302 and the mass 304 are enclosed within a common housing 305. The common housing 305 may have a variety of shapes, such as a cylindrical shape or rectangular parallelepiped shape.

The piezoelectric elements 302 are configured to be electrically actuated by, for example, applying a voltage or electric field to the piezoelectric elements 302. For example, each piezoelectric element 302 may comprise a suitable material (e.g., ceramic material) for displaying the piezoelectric effect (or inverse piezoelectric effect) and be positioned between two conductive plates (not indicated) that resemble a capacitor. When a voltage is applied, the piezoelectric elements 302 may contract in a predetermined manner thereby changing a size or shape of the piezoelectric actuator 301. As such, the piezoelectric elements 302 may collectively operate in moving the mass 304 from a first position in the first state 316 to a second position in the second state 318.

In the illustrated embodiment, the piezoelectric actuator 301 is a linear actuator such that the mass 304 is moved along an axis. The total distance moved along the axis is referenced as 315. As indicated by the bi-directional arrow in FIG. 6, the piezoelectric elements 302 are configured to repeatedly move the mass 304 to cause the vibrations. The mass 304 may be moved at a designated frequency. By way of example, the mass 304 may be moved at designated frequency between 100 Hz to 100 kHz. In particular embodiments, the designated frequency may be between 500 Hz to 1.0 kHz.

In some embodiments, the piezoelectric actuator 301 is configured to operate within a range of frequencies, such as between 100 Hz to 1.0 kHz. The frequency may be selected based on certain conditions within the target assembly or production chamber. An amplitude may also be selected based on certain conditions within the target assembly or production chamber. It is noted that other types of actuators may be use in other embodiments. For example, the piezoelectric actuator 301 may be a rotating actuator that moves an unbalanced mass about a designated axis.

As shown, the vibrating device 300 may include an electrical wire 314 that communicatively couples the vibrating device 300 to a control system, such as the control system 118 (FIG. 1). Alternatively, the vibrating device 300 may be controlled wirelessly. By repeatedly moving the mass 304, such as in an oscillating manner, the vibrating device 300 may cause vibrations to be transferred into a target body and/or move the target body such that the production chamber experiences vibrations therein. The target body may be similar or identical to the target body 201 (FIG. 2). The target body may also be characterized as being shaken by the vibrating device 300.

Figure 7:
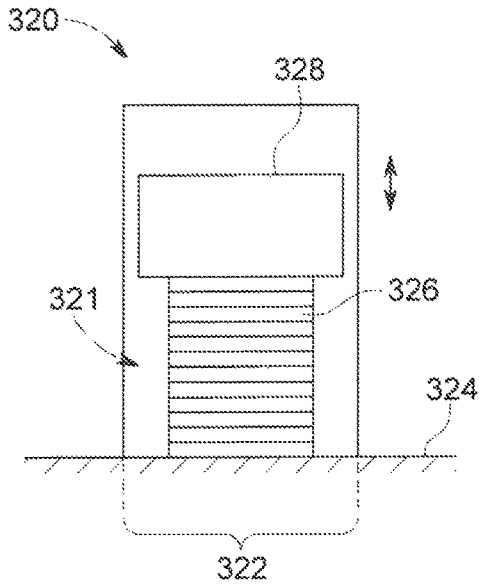
FIG. 7 is a side cross-section of a vibrating device in accordance with an embodiment that includes a piezoelectric actuator.

FIG. 7 is a side cross-section of a vibrating device 320 that may be used with one or more embodiments. The vibrating device 320 is secured to a designated surface 322 of a target body 324, which may be similar or identical to the target body 201 (FIG. 2). The designated surface 322 may be, for example, an exterior surface of the target body 324. In such embodiments, the vibrating device 320 may be readily accessible to a technician or user who has access to the target assembly (not shown). In other embodiments, however, the vibrating device 320 may be positioned within a device cavity. The device cavity may be open-sided or entirely enclosed by the target body 324.

The vibrating device 320 includes a piezoelectric actuator 321 having a stack of piezoelectric elements 326 and a mass or weight 328 that is coupled to an end of the stack. The piezoelectric elements 326 are configured to be actuated for repeatedly moving the mass 328 to cause the vibrations. The piezoelectric actuator 321 is a linear actuator such that the mass 328 is repeatedly moved toward and away from the designated surface 322 of the target body 324.

Figure 8:
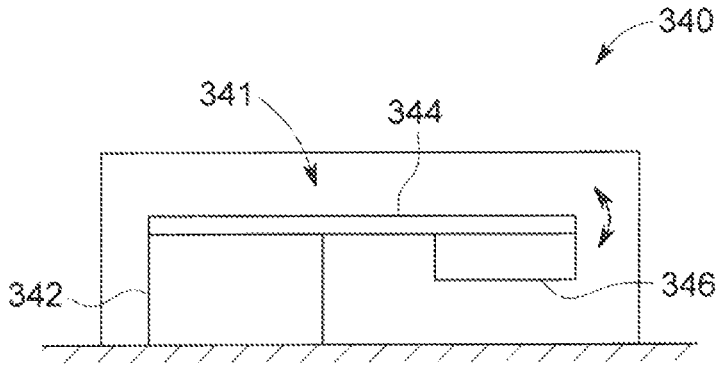
FIG. 8 is a side cross-section of a vibrating device in accordance with an embodiment that includes a piezoelectric actuator.

FIG. 8 is a side cross-section of vibrating device 340 that may be used with one or more embodiments. The vibrating device 340 includes a cantilevered-style piezoelectric actuator 341 that includes a base 342, a piezoelectric substrate 344, and a mass or weight 346 that is attached to the piezoelectric substrate 344. The piezoelectric substrate 344 may include a plurality of layers, including piezoelectric layers. The layers of the piezoelectric substrate 344 may collectively operate to flex between different states thereby causing the mass 346 to move (as indicated by the curved bi-direction arrow). The piezoelectric actuator 341 may repeatedly move the mass 346 to generate vibrations that are transferred into the target body.

Figure 9:
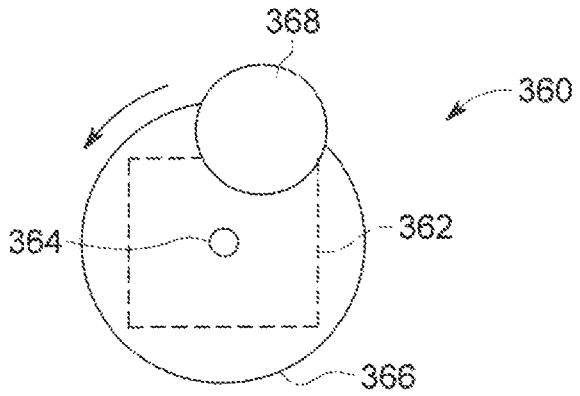
FIG. 9 is a top-down view of a vibrating device in accordance with an embodiment that includes an electric motor.

FIG. 9 is a top-down view of a vibrating device 360 that may be used with one or more embodiments. The vibrating device 360 includes an electric motor 362, a rotatable shaft 364, and a support disc 366. The rotatable shaft 364 is operably coupled to the electric motor 362, which is configured to rotate the rotatable shaft 364 about a corresponding axis. The rotatable shaft 364 is secured to a center of the support disc 366. The vibrating device 360 also includes a mass or weight 368 that is coupled to a non-central location of the support disc 366. When the electric motor 362 rotates the shaft 364, the mass 368 is repeatedly moved or displaced in an oscillating manner that causes vibrations.

Figure 10:
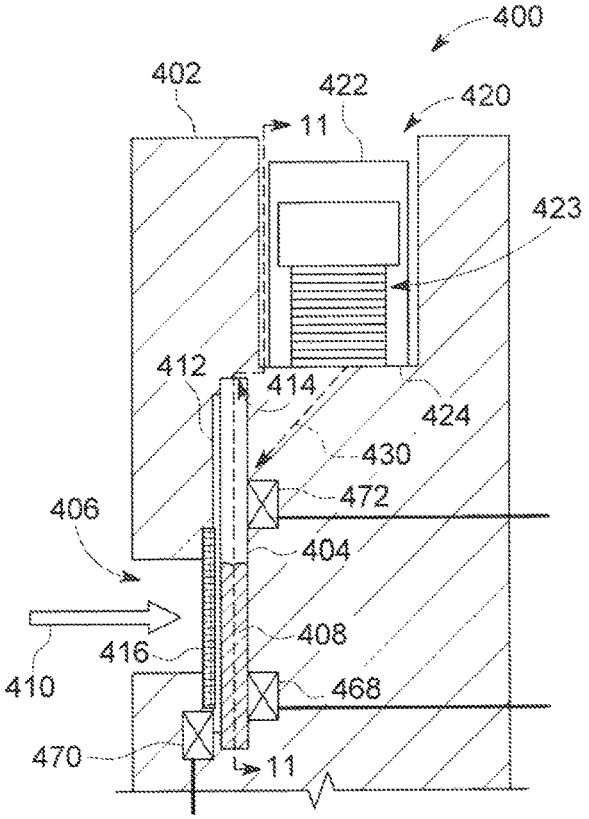
FIG. 10 is a side cross-section of a target assembly in accordance with an embodiment.
Figure 11:
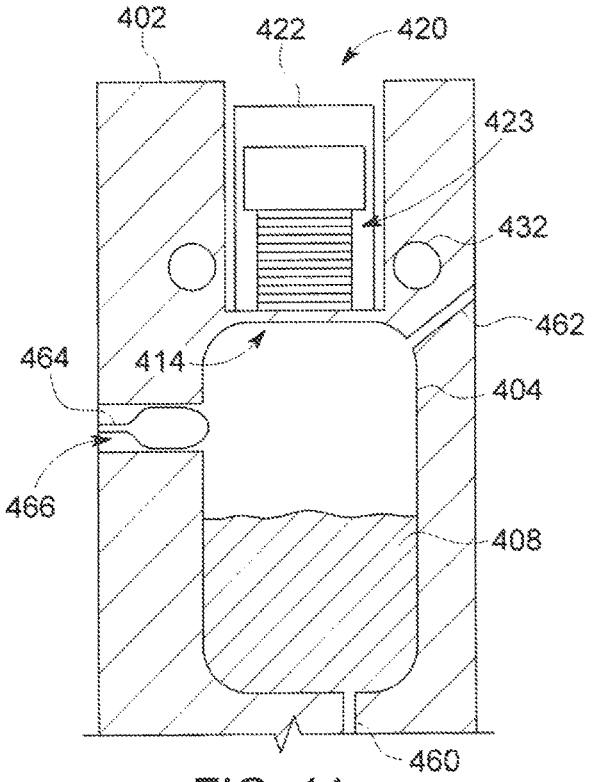
FIG. 11 is a front cross-section of the target assembly of FIG. 10.

FIG. 10 is a side cross-section of a target assembly 400, and FIG. 11 is a staged or stepped cross-section of the target assembly 400 taken along the line 11-11 in FIG. 10. The target assembly 400 may be similar to the target assembly 200 (FIG. 2) and be used with the isotope production system 100 (FIG. 1). As shown, the target assembly 400 includes a target body 402 having a production chamber 404 and a beam cavity 406 (FIG. 10) that is adjacent to the production chamber 404. The production chamber 404 is configured to hold a target liquid 408. As shown in FIG. 10, the beam cavity 406 opens to an exterior of the target body 402 to receive a particle beam 410 that is incident on the production chamber 404.

The production chamber 404 is defined by a foil member 412 (FIG. 10) and an interior surface 414. It is understood that the production chamber 404 may be defined by more than one interior surface 414. During operation, pressure generated within the production chamber 404 is directed toward the beam cavity 406. The pressure may be, for example, between 1.00 and 15.00 MPa or, more specifically, between 2.00 and 11.00 MPa. To prevent the foil member 412 from being pushed out from the beam cavity 406, the foil member 412 is supported by a matrix wall 416 (FIG. 10) that extends across the beam cavity 406. The matrix wall 416 includes a plurality of interconnected walls that form holes. The walls may form, for example, a hexagonal pattern. The holes permit the particle beam 410 to project through the matrix wall 416 and be incident on the target liquid 408. However, it should be understood that the matrix wall 416 is optional and that other embodiments may not include the matrix wall 416.

The target body 402 defines a device cavity 420 that is sized and shaped to receive a vibrating device 422 of the target assembly 400. The vibrating device 422 may include one or more of the vibrating devices 422 described herein. For example, the vibrating device 422 includes a piezoelectric actuator 423. Alternatively, the vibrating device 422 may include an electric motor. In the illustrated embodiment, the vibrating device 422 is entirely disposed within the device cavity 420. In other embodiments, however, the vibrating device 422 may be only partially disposed within the device cavity 420.

The vibrating device 422 is secured to a designated surface 424 (FIG. 10) of the target body 402 that defines a portion of the device cavity 420. By way of example, the vibrating device 422 may be secured using a fastener and/or an adhesive. In some cases, the vibrating device 422 may be at least partially held by an interference fit between the vibrating device 422 and the target body 402. In some embodiments, a cap or cover may be placed over the device cavity 420 and hold the vibrating device 422 against the designated surface 424.

In FIGS. 10 and 11, the target body 402 is represented by only a single body section that comprises a solid material. In other embodiments, the target body 402 may comprise a plurality of body sections, such as the body sections 202, 204, 206 (FIG. 2). In particular embodiments, a continuous path 430 through the solid material may exist between the designated surface 424 and the interior surface 414 that defines the production chamber 404. In some embodiments, the distance along the continuous path 430 between the designated surface 424 and the interior surface 414 is less than ten (10) centimeters (cm). In particular embodiments, the distance may be less than five (5) cm. In more particular embodiments, the distance may be less than three (3) cm.

As shown in FIG. 11, the target body 402 may include one or more cooling channels 432 that extend through the solid material of the target body 402 and proximate to the designated surface 424 or the device cavity 420. For example, at least one of the cooling channels 432 may be less than five (5) cm away or less than three (3) cm away from the designated surface 424 or the device cavity 420. In particular embodiments, at least one of the cooling channels 432 may be less than two (2) cm away or less than one (1) cm away from the designated surface 424 or the device cavity 420.

The cooling channel(s) 432 are configured to have a liquid or gas flow therethrough that absorbs thermal energy generated by the vibrating device 422. In particular embodiments, the cooling channels 432 are part of the fluidic circuit that extends through the target body 402 to actively cool the production chamber 404. For example, the cooling channels 432 may be in flow communication with one or more of the cooling channels (not shown) that extend proximate to the production chamber 404.

Also shown in FIG. 11, the target body 402 may form a first channel 460 and a second channel 462 that are in flow communication with the production chamber 404. The first channel 460 may be configured to provide the target liquid 408. The second channel 462 may be configured to provide an inert gas, such as helium or argon, for pressurizing the target liquid 408 within the production chamber 408. It should be understood that additional channels may be in flow communication with the production chamber 404.

FIG. 11 also shows a pressure sensor 464 that is positioned within a cavity 466 of the target body 402. The pressure sensor 464 is configured to detect a pressure of the production chamber 404. For example, the pressure may increase when the particle beam is incident on the target liquid 408. FIG. 10 illustrates first and second temperature sensors 468, 470. The first temperature sensor 468 may be positioned to detect a temperature of the target liquid 408. The second temperature sensor 470 may be positioned to detect a temperature of the foil 412 and/or the matrix wall 416. Data from the second temperature sensor 470 may be used to determine if the foil is about to rupture. In other embodiments, at least one of the first or second temperature sensors 468, 470 may be an electrical contact that communicates signals that correlate to a beam current. Optionally, the target assembly 400 may include a liquid-level detector 472 that may be positioned adjacent to a location of an interface between a liquid and gas within the production chamber 404. Data obtained through the liquid-level detector 472 may be configured to determine a level of an interface between gas and liquid within the production chamber. In some embodiments, data from the liquid-level detector 472 may be used to determine a density of the liquid.

Figure 12:
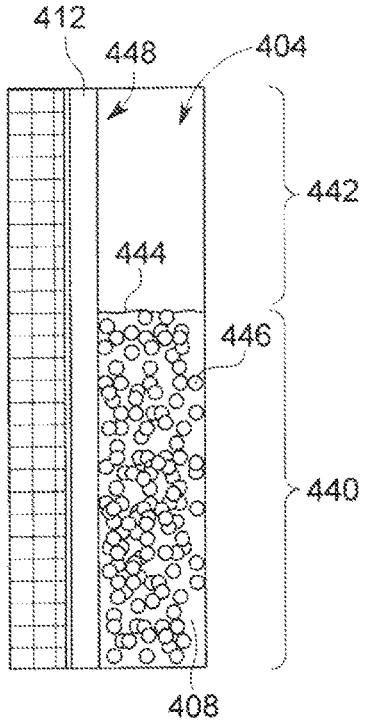
FIG. 12 is an enlarged view of a production chamber of the target assembly of FIG. 10.

FIG. 12 is an enlarged cross-section of the production chamber 404 during radioisotope generation. The production chamber 404 has a total space or volume that includes a liquid region 440 and a gas or vapor region 442. The total space of the production chamber 404 may be, for example, between 0.5 milliliters (ml) and 5.0 ml or, more specifically, between 1.0 ml and 3.0 ml. The liquid region 440 includes the target liquid 408 and bubbles 446 generated within the production chamber 404, and the gas region 442 may include an inert gas, vapor, and gases generated by the bubbles 446. The liquid and gas regions 440, 442 may have an interface 444 that generally represents a division between the liquid and gas regions 440, 442. It is understood, however, that it may be difficult to identity the interface 444 and the interface 444 may rise or lower throughout operation. When the target liquid 408 is loaded into the production chamber 404, the target liquid 408 may have, for example, a liquid volume that is more than 50% of the total volume of the production chamber 404. In some embodiments, the liquid volume of the target liquid 408 is more than 60% or more than 70% of the total volume. In more particular embodiments, the liquid volume of the target liquid 408 is more than 75%, more than 80%, or more than 85% of the total volume.

During operation of the isotope production system, the bubbles 446 may be formed within the liquid region 440. The bubbles 446 may be formed along an interior surface 448 of the foil member 412 and within the liquid region 440. As described herein, the vibrating device 422 may provide vibrations that are experienced by the production chamber 404. For example, the vibrations may move the interior surfaces 414 and 148 that define the production chamber 404 and/or may shake or cause disturbances within the target liquid 408. Compared to conventional systems that do not have a vibrating device, the vibrations may at least one (a) detach the bubbles 446 from the interior surface 448 more quickly; (b) cause the gases that form the bubbles 446 to rise more quickly to the gas region 442; or (c) cause the bubbles to burst more quickly along the interface 444.

Figure 13:
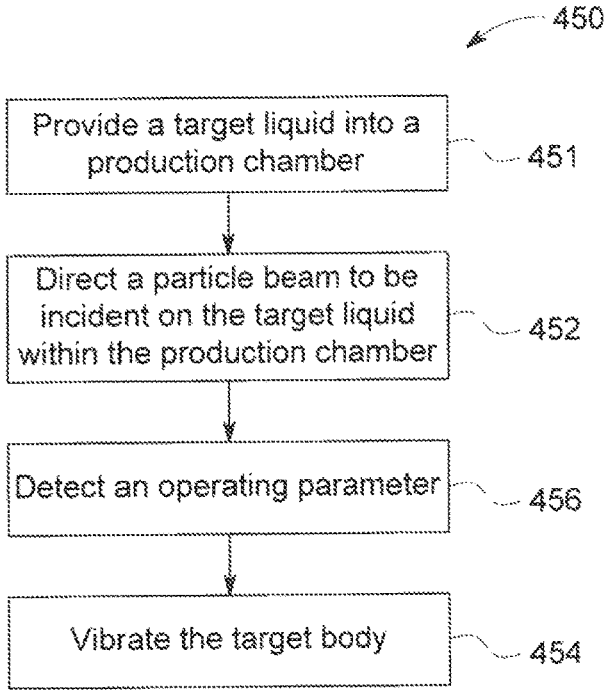
FIG. 13 is a flow chart of a method of generating radioisotopes in accordance with an embodiment.

FIG. 13 illustrates a flowchart of a method 450 of generating radioisotopes in accordance with an embodiment. The method 450, for example, may employ structures or aspects of various embodiments (e.g., systems and/or methods) discussed herein. In various embodiments, certain steps may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion. The steps may be carried out or performed by, for example, an isotope production system, such as the system 100.

The method 450 includes providing, at 451, a target liquid into a production chamber of a target body. For example, a fluid-control system may provide a designated volume of the target liquid into the production chamber. The designated volume may be, for example, about 1 ml to about 3 ml. In some embodiments, the method 450 may include detecting a level of the target liquid within the production chamber. For example, a liquid-level sensor, such as the liquid-level sensor 472 may include a light source (e.g., bulb or light-emitting diode (LED)) and a photodetector. The light source may be positioned adjacent to or opposite the photodetector. When the light source is activated, the photodetector may be configured to detect an amount of light. The amount of light detected by the liquid-level sensor 472 may change based on a volume, level, or density of the liquid within the production chamber. In some embodiments, the liquid-level sensor 472 may be a density detector. For example, the bubbles may cause a foam-like quality of the liquid that is detectable by the liquid-level sensor 472. Accordingly, data obtained by the liquid-level sensor 472 may be correlated to a density of the liquid and/or may be used to estimate a density of the liquid.

In some embodiments, the method 450 may include applying a pressure to the target liquid. The pressure may be increased by supplying an inert gas, such as helium or argon, into the production chamber. The pressure may be detected by a pressure sensor, such as the pressure sensor 464.

The method 450 also includes directing, at 452, a particle beam to be incident on a target liquid within a production chamber of a target body. As described herein, the production chamber may include a liquid region and a gas region. The gas region typically exists above the liquid region (relative to gravity). The particle beam deposits a relatively large amount of power within a relatively small volume of the target liquid thereby causing bubbles to form within the liquid region of the production chamber. For example, the bubbles may be formed along an interior surface that defines the production chamber. The interior surfaces may include, for example, an interior surface of a foil that intercepts the particle beam and/or an interior surface of the target body. The bubbles may also be formed from within the liquid region away from the interior surfaces.

At 454, the target body may be vibrated (or shaken) to cause the bubbles to move from the liquid region to the gas region. For example, a vibrating device may be secured to the target body at a designated location and activated to cause vibrations that are experienced within the production chamber as described herein. The vibrating device may be a discrete component that is secured to a surface of the target body. The surface may be an exterior surface, a surface that defines an open-sided cavity, or a surface that defines an enclosed cavity.

The vibrating device may be activated at a designated time. For example the vibrating device may be activated when the particle accelerator generates a particle beam, when the particle beam is incident on the target material, or a predetermined period of time after the particle beam is incident on the target material. Optionally, the method may include detecting, at 456, an operating parameter that is associated with a baseline density of the target liquid. For example, a control system, such as the control system 118 (FIG. 1), may be operatively coupled to one or more sensors that detect data during operation of the isotope production system.

The data may correspond to one or more operating parameters or system parameters. An operating parameter is a parameter that changes during operation of the system and may be monitored during operation of the system. For example, an operating parameter may be a beam current, a temperature of the target body, a temperature of the foil, a pressure within the production chamber, a level of the interface between gas and liquid, a density of the liquid, or an amount of time that the particle beam has been incident on the target liquid. Data corresponding to the operating parameters may be obtained directly through one or more sensors or, alternatively, may be extrapolated based on other data. A system parameter may be a known variable. For example, a system parameter may be the type of target liquid, the total volume of the production chamber, the total volume of the target liquid.

The control system may be communicatively coupled to various sensors, transducer, detectors, and/or monitors, such as those described herein. Data corresponding to the operating and system parameters may be used to determine or calculate a density of the target liquid within the production chamber. When the density is determined to fall below a baseline value, the vibrating device may be activated. For example, the liquid-level sensor (or density detector) may communicate data signals that indicate a state in which an excessive amount of hubbies exists within the production chamber. If the density of the production chamber is determined to be below a baseline value, the vibrating device may be activated. As another example, the control system 118 may detect a beam current of the particle beam. The beam current may be detected through an electrical contact that engages the target body. When the beam current exceeds a designated threshold, the control system may determine that the density is too low and the vibrating device may be activated. The designated thresholds and baselines may be known values that are stored by the control system or may be values that are calculated by the control system during operation of the isotope production system. The designated threshold beam current may be a variety of values depending upon the system. By way of example, the threshold beam current may be at least 10 μA, at least 20 μA, at least 30 μA, at least 40 μA, at least 50 μA, at least 60 μA, or more. In other embodiments, the threshold beam current may be at least 70 μA, at least 80 μA, at least 90 μA, at least 100 μA, at least 110 μA, at least 120 μA, or more. Yet in other embodiments, the threshold beam current may be at least 150 μA, at least 175 μA, at least 200 μA, at least 225 μA, at least 250 μA, or more.

In some embodiments, the vibrating device is not activated continuously for an extended period of time. Instead, the control system may activate the vibrating device in a periodic (or non-periodic) manner. The activation may be configured to increase the density of the target liquid and may be based on data relating to the operating and system parameters. Accordingly, the vibrating device may be activated based on feedback relating to conditions within the production chamber.

To this end, the control system may include components that include or represent hardware circuits or circuitry. The hardware circuits or circuitry may include and/or be connected with one or more processors, such as one or more computer microprocessors or other logic-based circuitry. The operations of the methods described herein and the control system can be sufficiently complex such that the operations cannot be mentally performed by an average human being or a person of ordinary skill in the art within a commercially reasonable time period. The hardware circuits and/or processors of the control system may be used to significantly reduce the time needed to determine when to activate the vibrating device or to determine an activation schedule of the vibrating device.

The control system may be located with the isotope production system or may have one or more components located remotely with respect to the isotope production system. The control system may include an input device that obtains user inputs and other data used to determine when to activate the vibrating device.

In the exemplary embodiment, the control system executes a set of instructions that are stored in one or more storage elements, memories, or modules in order to at least one of obtain and analyze data corresponding to the operating and system parameters. Storage elements may be in the form of information sources or physical memory elements within the control system. Embodiments include non-transitory computer-readable media that include set of instructions for performing or executing one or more processes set forth herein. Non-transitory computer readable media may include all computer-readable media, except for transitory propagating signals per se. The non-transitory computer readable media may include generally any tangible computer-readable medium including, for example, persistent memory such as magnetic and/or optical disks, ROM, and PROM and volatile memory such as RAM. The computer-readable medium may store instructions for execution by one or more processors.

The set of instructions may include various commands that instruct the control system to perform specific operations such as the methods and processes of the various embodiments described herein. The set of instructions may be in the form of a software program. As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Components of the control system may include or represent hardware circuits or circuitry that include and/or are connected with one or more processors, such as one or more computer microprocessors. The operations of the methods described herein and the control system can be sufficiently complex such that the operations cannot be mentally performed by an average human being or a person of ordinary skill in the art within a commercially reasonable time period.

The software may be in various forms such as system software or application software. Further, the software may be in the form of a collection of separate programs, or a program module within a larger program or a portion of a program module. The software also may include modular programming in the form of object-oriented programming. After obtaining the data, the data may be automatically processed by the control system, processed in response to user inputs, or processed in response to a request made by another processing machine (e.g., a remote request through a communication link).

Embodiments described herein are not intended to be limited to generating radioisotopes for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand alone programs, may be incorporated as subroutines in an operating system, may be functions in an installed software package, or the like. The various embodiments are not limited to the arrangements and instrumentality shown in the drawings.

What is claimed is:

1. An isotope production system comprising:

a particle accelerator configured to generate a particle beam;

a target assembly including a target body having a production chamber and a beam cavity that is adjacent to the production chamber, the production chamber configured to hold a target liquid, the beam cavity positioned to receive the particle beam from the particle accelerator such that the particle beam is incident on the production chamber, the target assembly including a vibrating device secured to the target body; and a control system operatively coupled to the particle accelerator and the target assembly, the control system configured to activate the vibrating device at a designated time after the particle beam is generated, the vibrating device configured to cause vibrations that are experienced within the production chamber;

wherein the control system is configured to activate the vibrating device in response to determining that the particle beam has obtained a threshold beam current.

2. An isotope production system comprising:

a particle accelerator configured to generate a particle beam;

a target assembly including a target body having a production chamber and a beam cavity that is adjacent to the production chamber, the production chamber configured to hold a target liquid, the beam cavity positioned to receive the particle beam from the particle accelerator such that the particle beam is incident on the production chamber, the target assembly including a vibrating device secured to the target body; and a control system operatively coupled to the particle accelerator and the target assembly, the control system configured to activate the vibrating device, the vibrating device configured to cause vibrations that are experienced within the production chamber;

wherein the control system is configured to activate the vibrating device in response to determining that an operating parameter has satisfied a predetermined condition, the operating parameter changing during operation of the isotope production system.

3. An isotope production system comprising:

a particle accelerator configured to generate a particle beam;

a target assembly including a target body having a production chamber and a beam cavity that is adjacent to the production chamber, the production chamber configured to hold a target liquid, the beam cavity positioned to receive the particle beam from the particle accelerator such that the particle beam is incident on the production chamber, the target assembly including a vibrating device secured to the target body; and a control system operatively coupled to the particle accelerator and the target assembly, the control system configured to activate the vibrating device, the vibrating device configured to cause vibrations that are experienced within the production chamber;

wherein the vibrating device is configured to operate within a range of operating frequencies, the control system configured to select an operating frequency of the vibrating device.

4. The isotope production system of claim 1, wherein the target body includes first and second body sections that are secured to one another in fixed positions with respect to one another, the production chamber being defined by at least one of the first body section or the second body section, the vibrating device being secured to at least one of the first body section or the second body section.

5. The isotope production system of claim 1, wherein the vibrating device is secured to a designated surface of the target body, the target body comprising a solid material, wherein a continuous path of the solid material exists between the designated surface and a surface that defines the production chamber.

6. The isotope production system of claim 1, wherein the vibrating device includes at least one of (a) a piezoelectric actuator or (b) an electric motor.

7. The isotope production system of claim 2, wherein the control system is configured to activate the vibrating device in response to determining that the target liquid has a density that is less than a predetermined value.

8. An isotope production system comprising:

a particle accelerator configured to generate a particle beam;

a target assembly including a target body having a production chamber and a beam cavity that is adjacent to the production chamber, the production chamber configured to hold a target liquid, the beam cavity positioned to receive the particle beam from the particle accelerator such that the particle beam is incident on the production chamber, the target assembly including a vibrating device secured to the target body; and a control system operatively coupled to the particle accelerator and the target assembly, the control system configured to activate the vibrating device, the vibrating device configured to cause vibrations that are experienced within the production chamber;

wherein the vibrating device is configured to operate within a range of operating frequencies, the control system configured to select an operating frequency of the vibrating device;

wherein the control system is configured to select the operating frequency of the vibrating device in response to a beam current of the particle beam.

9. An isotope production system comprising:

a particle accelerator configured to generate a particle beam;

a target assembly including a target body having a production chamber and a beam cavity that is adjacent to the production chamber, the production chamber configured to hold a target liquid, the beam cavity positioned to receive the particle beam from the particle accelerator such that the particle beam is incident on the production chamber, the target assembly including a vibrating device secured to the target body; and a control system operatively coupled to the particle accelerator and the target assembly, the control system configured to activate the vibrating device, the vibrating device configured to cause vibrations that are experienced within the production chamber;

wherein the vibrating device is configured to operate within a range of operating frequencies, the control system configured to select an operating frequency of the vibrating device; and wherein the control system is configured to select the operating frequency of the vibrating device in response to an operating parameter of the isotope production system.

10. The isotope production system of claim 1, wherein the designated time is a predetermined period of time after the particle beam is incident on the target material.

11. The isotope production system of claim 1, wherein the designated time is a period of time when the particle accelerator generates a particle beam.

12. The isotope production system of claim 1, wherein the designated time is a period of time when the particle beam is incident on the target material.

13. The isotope production system of claim 1, wherein the particle beam is a proton beam.

* * * * *